United States Patent [19]

Martin

[11] 4,252,641

[45] Feb. 24, 1981

[54] PRESSURIZED SCREEN

[75] Inventor: Andrew C. Martin, Middletown, Ohio

[73] Assignee: The Black Clawson Company, Middletown, Ohio

[21] Appl. No.: 64,241

[22] Filed: Aug. 6, 1979

[51] Int. Cl.[3] ..... B07B 1/18

[52] U.S. Cl. ..... 209/273; 210/456

[58] Field of Search ..... 209/262, 273, 305, 306, 209/379, 270; 210/39 E, 415, 456

[56] References Cited

U.S. PATENT DOCUMENTS

| | | | |
|---|---|---|---|
| 3,174,622 | 3/1965 | Lamort | 209/273 |
| 3,394,809 | 7/1968 | Hunter | 209/73 |
| 3,420,373 | 1/1969 | Hunter | 209/273 |
| 3,581,903 | 6/1971 | Holz | 210/415 |
| 3,784,495 | 1/1974 | Holz | 209/273 X |
| 3,898,157 | 8/1975 | Hooper | 209/306 |
| 4,127,479 | 11/1978 | Kurth et al. | 209/273 |

*Primary Examiner*—William A. Cuchlinski, Jr.
*Attorney, Agent, or Firm*—Biebel, French & Nauman

[57] ABSTRACT

A pressurized screen particularly adapted for screening paper making pulp includes a cylindrical screen plate mounted in a cylindrical casing and defining with it an annular chamber which receives unscreened pulp from which rejects are removed as the good pulp passes from the annular chamber through the screen plate. The axes of the screen plate and the casing are offset with respect to each other, forming an enlargement of the chamber which extends approximately from an inlet into the annular chamber to a rejects outlet which is diametrically opposite the inlet. A partition in the chamber extends parallel to the axes of the casing and screen plate from a position opposite the inlet to a position above the rejects outlet. The partition is spaced from the opposing inner and outer surfaces of the screen and casing, respectively, and a baffle is provided which extends co-extensively with the partition and slopes helically downwardly about the screen plate from the inlet to the rejects outlet and defines with the partition, the screen plate and a floor of the chamber, a passage of decreasing cross-sectional area. Inlets are also provided for adding dilution liquid to the passage upstream of the rejects outlet and a purging liquid just upstream of the rejects outlet.

13 Claims, 7 Drawing Figures

PRESSURIZED SCREEN

BACKGROUND OF THE INVENTION

Pressurized screens which include a cylindrical casing having a cylindrical screen plate mounted within it to define an annular space into which the material to be screened is received are well known in the art. In apparatus of this type rotating foils may be provided adjacent either the inner or outer face of the screen plate and flow may either be outwardly through the screen plate into the annular chamber formed by the screen plate outer face and the inner surface of the casing or inwardly in the opposite direction. Examples of apparatus of this latter type are shown in U.S. Pat. Nos. 3,174,622 of Mar. 23, 1965; 3,394,809 of July 30, 1968; 3,581,903 of June 1, 1971; 3,898,157 of Aug. 5, 1975; and 4,127,479 of Nov. 28, 1978.

One difficulty encountered with apparatus of the type described generally above is that where the flow is inwardly through the screen plate and the pulp is introduced through a wall of the casing and the rejects are removed through another opening there may be a short circuiting effect in that pulp may flow directly from the inlet to the reject outlet without first circling the screen plate. This will obviously result in substantial loss of good fibers.

Another disadvantage encountered in screens of this type is that as the paper making pulp is introduced into the chamber at a high velocity from the inlet it strikes the surface of the cylindrical screen plate, driving undesirable particles into the openings through the screen plate and either thereby passing undesirable particles through the screen plate by force or plugging some of the screen plate openings.

In some apparatus of this type the geometry of the chamber defined by the outer surface of the screen plate and the inner surface of the casing is such that eddies and general hydraulic inefficiency exists in the chamber about the screen. While U.S. Pat. Nos. 3,394,809 and 3,898,157 utilize spiral ramps to organize flow in the area about the screen plate, the resulting assembly is necessarily complex with attendant difficulties in manufacture and maintenance.

SUMMARY OF THE INVENTION

The present invention is directed to a pressurized, inward flow screen which obviates the prior art problems of short circuiting flow, direct impingement of incoming pulp on the screen plate surface, and general hydraulic inefficiency in the feed chamber without complex manufacturing and maintenance requirements.

Specifically, a screen assembly in accordance with the present invention has the axes of the cylindrical screen plate and the casing surrounding the screen plate offset with respect to each other to form an enlargement in the annular chamber surrounding the screen plate. A partition is mounted in the enlargement extending from the inlet opening to adjacent the rejects outlet opening, which is positioned substantially diametrically opposite the inlet.

A baffle circles the screen plate helically substantially co-extensively with the partition and provides a passage of decreasing cross-sectional area as it approaches the rejects outlet.

With this construction incoming material to be screened is directed around the cylindrical screen plate until, at a point approximately where the inlet enters the casing, the flow is directed into the passage of decreasing cross-sectional area toward the rejects outlet. This results in movement of the material at optimum velocities that prevent plugging of the passages and also an orientation of larger and enlongated particles parallel with the screen plate.

It will also be noted that with the above arrangement the pulp circles the screen plate approximately one and a half times, not only preventing short circuiting of the pulp from the inlet directly to the reject outlet, but providing a more effective screening.

It will also be noted that the provision of the partition extending from adjacent the inlet to approximately the position of the rejects outlet prevents material being introduced into the chamber from being driven by force into or through the openings of the cylindrical screen plate.

At a point in the passage of decreasing area dilution liquid is added, decreasing the consistency of the material and thereby increasing the efficiency of the screening at this point. This also promotes the washing of desirable particles from undesirable rejects.

Finally, just before the rejects outlet is reached, a purging liquid is introduced into the system. This increases flow rates and improves the carrying capacity of the outlet flow so that larger rejects that might otherwise settle out are carried out of the system.

DESCRIPTION OF THE PREFERRED EMBODIMENTS

Figure 1:
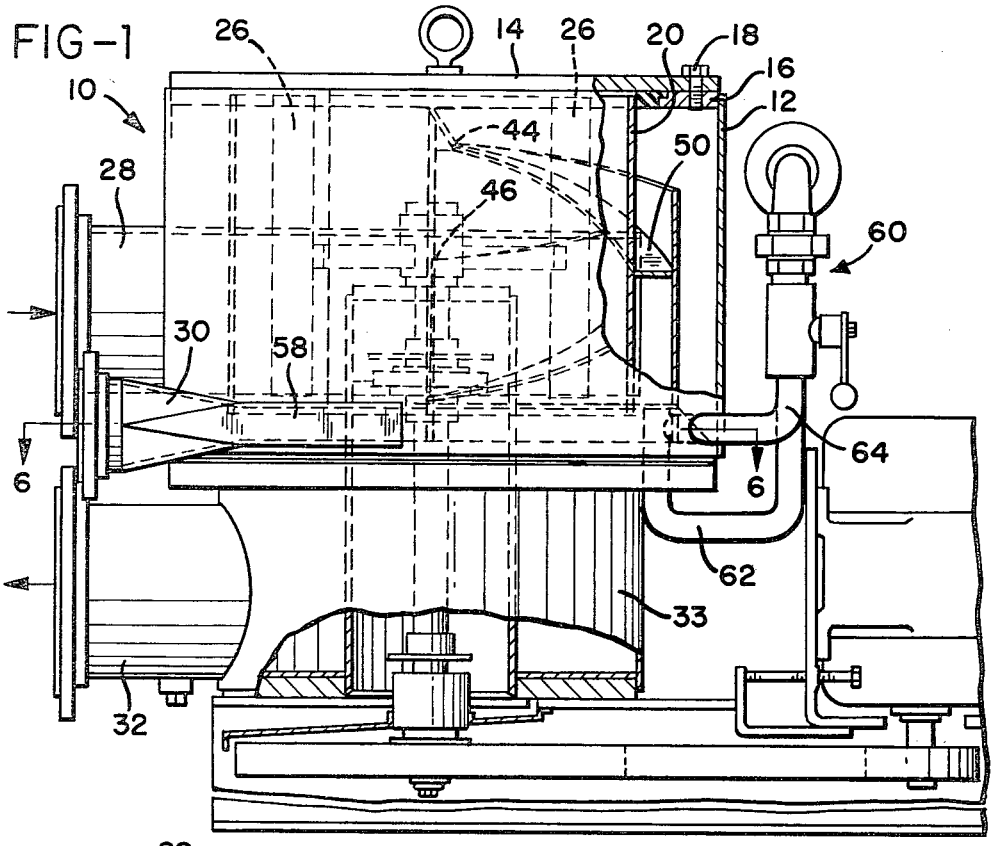
FIG. 1 is an elevational view of the screen assembly of the prevent invention with portions removed for clarity.

Screen assembly 10 of the present invention includes an outer cylindrical casing 12, a cover 14 extending across the casing 12 and secured to a flange 16 of the casing by means of bolts or the like 18. A cylindrical screen plate 20 is disposed within the casing 12 with an outer surface of the screen plate spaced from an inner surface of the casing. A floor 22 defines with the casing 12, the screen plate 20 and the cover 14 an annular chamber 24 surrounding the screen plate 20.

Figure 2:
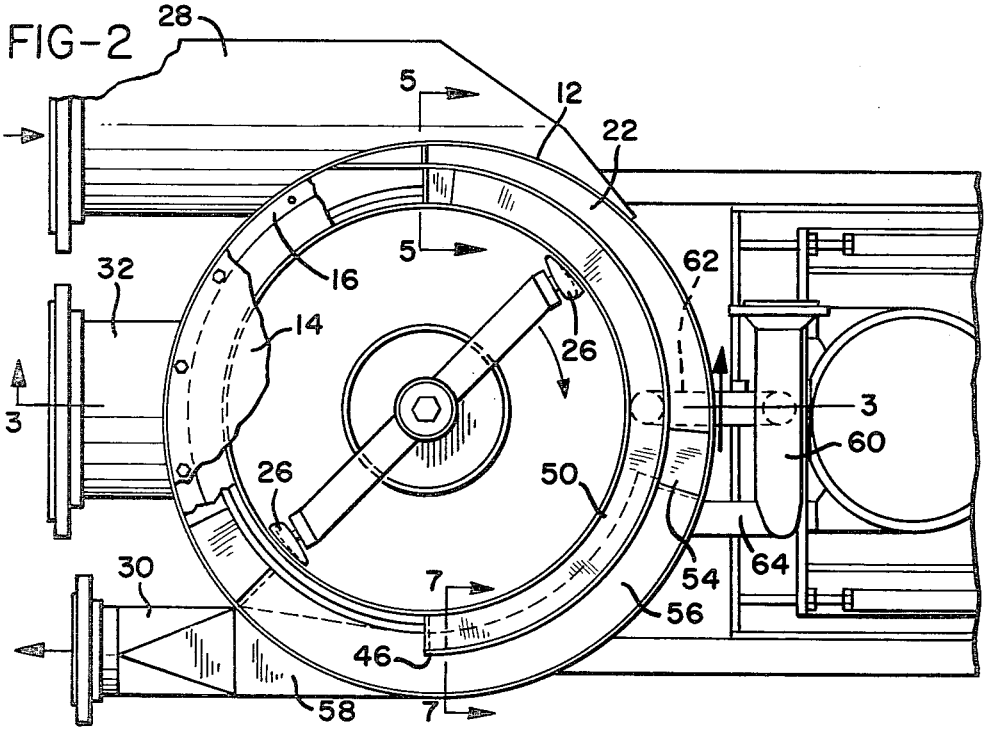
FIG. 2 is a plan view of the screen assembly with portions of the cover removed.

As seen in FIG. 2 of the drawings foils 26, which may be of conventional design, are mounted for rotation within the screen plate 20 to maintain the openings through the screen plate clear. Since the foils 26 may be of conventional design and function generally in a conventional manner they have, for purposes of clarity, been omitted from the other figures of the drawings.

Figure 4:
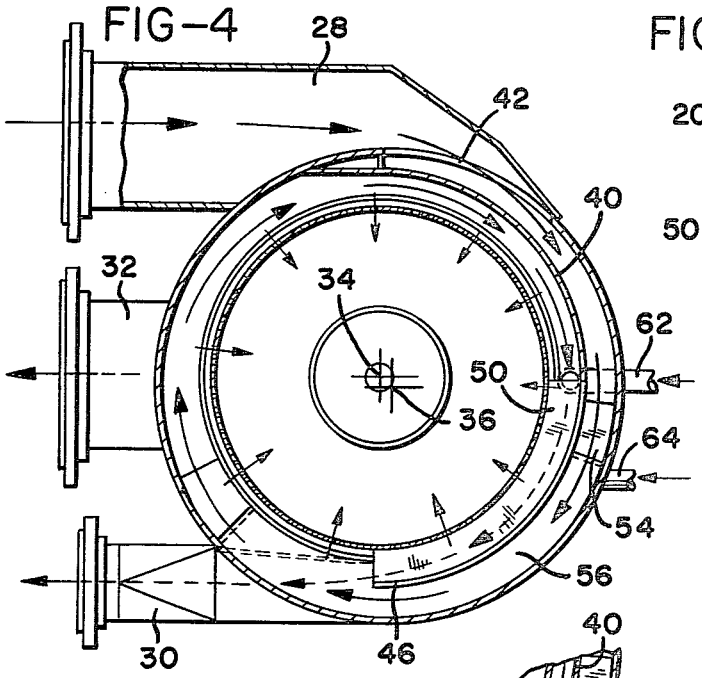
FIG. 4 is a cross-sectional view taken on line 4—4 of FIG. 3.

At inlet 28 is provided for delivering the material to be screened, such as paper making pulp, into the chamber 24 and a rejects outlet 30 is provided disposed substantially diametrically opposite the inlet 28 when viewed from above, as in FIGS. 2 and 4 of the drawings.

An accepts outlet 32 communicates with the interior of the screen plate 20 and acceptable material which has passed through the screen plate 20 into the lower chamber 33 is withdrawn through the accepts outlet 32.

It will be particularly noted from FIG. 4 of the drawings that the axis 34 of the screen plate 20 is offset with respect to the axis 36 of the casing 12. This results in an enlargement 38 in the annular chamber 24 intermediate the inlet 28 and the rejects outlet 30.

Within this enlargement 38 a partition 40 is mounted extending substantially parallel to the axes 34 and 36 intermediate the inner and outer surfaces of the casing 12 and screen plate 20, respectively. As can be seen in FIG. 4 of the drawings, the partition 40 extends from a point upstream of the opening 42 for the inlet 28 to a point adjacent the rejects outlet 30. With reference to FIG. 1 of the drawings it will also be seen that the partition 40 extends from a maximum height at point 44 adjacent inlet 28 to a minimum height at its opposite end 46 adjacent the rejects outlet 30.

Figure 7:
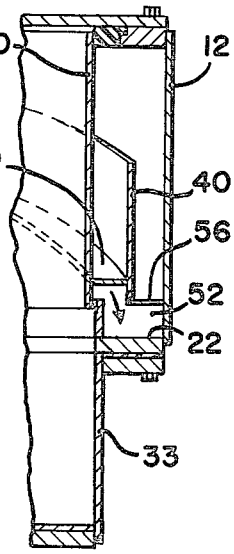
FIG. 7 is a cross-sectional view taken on line 7—7 of FIG. 2.

A baffle 50 extends substantially co-extensively with the partition 40 between an inner surface of the partition 40 and the outer surface of the screen plate 20 and is secured to the partition 40 by means of welding or the like. Baffle 50 extends helically about the screen plate 20 from point 44 on the partition 40 down to the upper surface of the rejects outlet 30. As a result the baffle 50 together with adjacent surfaces of the partition 40, screen plate 20 and floor 22 defines a passage 52 which decreases in cross-sectional area from point 44 down to the rejects outlet 30, at which point it widens abruptly as can be seen in FIG. 7 of the drawings.

It will be noted from FIGS. 2 and 4 that the floor 22 is provided with a ramp 54 just upstream of the rejects outlet 30 which extends upwardly at an angle and then is continued with a short section 56 which, as shown in FIGS. 1 and 2 of the drawings, merges with an upper wall 58 of the rejects outlet 30.

Figure 3:
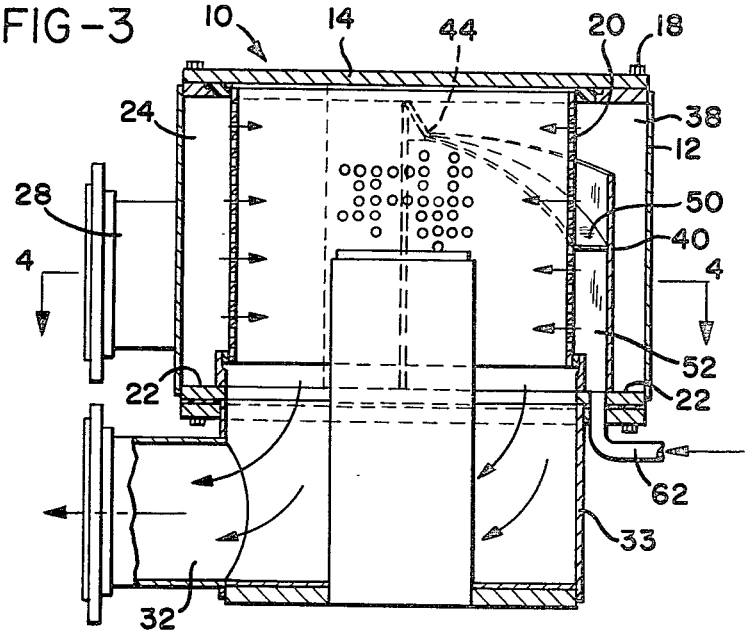
FIG. 3 is a cross-sectional view taken on line 3—3 of FIG. 2.
Figure 5:
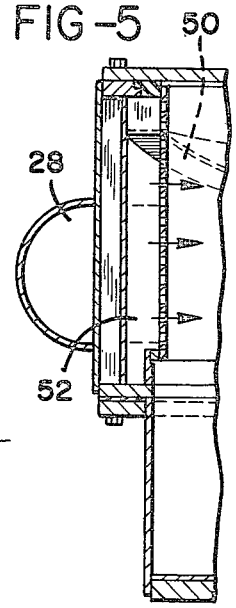
FIG. 5 is a view taken on line 5—5 of FIG. 2.
Figure 6:
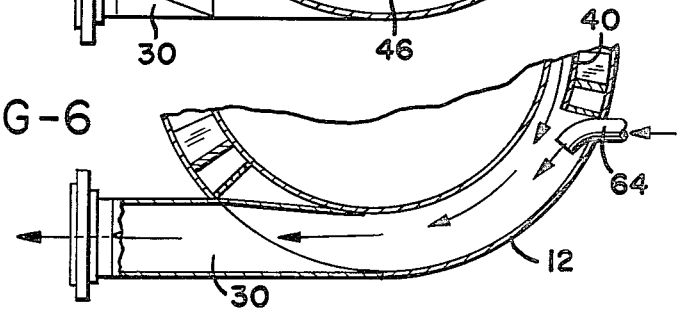
FIG. 6 is a partial cross-sectional view of the bottom of the chamber showing the rejects outlet and purge feed.

A manifold 60 provides two additional sources of liquid through lines 62 and 64 as seen in FIGS. 1, 2 and 4 of the drawings. The first line 62, also seen in FIG. 3, provides a dilution liquid through the floor 22 into passage 52 for purposes previously described, while the line 64, which is also shown in FIG. 6 of the drawings, is utilized to introduce a purging liquid into the enlarged section of passage 52 immediately upstream of the rejects outlet 30 to facilitate the removal of rejects through outlet 30.

In operation the material to be screened, such as paper making pulp, is delivered to the assembly through the inlet 28 and the opening 42 and passes into the enlargement 38 of annular chamber 24. Because of the presence of the partition 40 the incoming material does not impinge directly on the screen plate 20 but must flow around the annular space 24 with some of the flow passing over the upper edge of the partition 40 and through the adjacent surface of the screen plate 20. Additionally, because of the partition 40, the baffle 50, the ramp 54 and the section 56 there is no short circuiting flow directly from the inlet 28 to the rejects outlet 30. Instead the flow continues around the screen, occupying the full area of the annular space 24 once the lower end 46 of the partition is passed and finally entering into the passage 52 beneath the baffle 50.

As a result of the partition 40 and the decreasing volume of the passage 50 an organized flow of material will occur with velocities high enough to orient larger and elongated particles parallel with the screen plate, thereby preventing plugging and also reducing the possibility of the passage of long pieces through the openings in the screen plate 20.

Additionally, any undesirable particles settling out against the screen plate 20 will be repulsed by the pulsating action of the foils 26 and will be picked up and carried toward the rejects outlet by the material moving around the screen plate 20 at relatively high velocities.

The enlarged area of the passage 52 adjacent the rejects outlet and the introduction of liquid into this area facilitates the separation of desirable material from undesirable rejects, and in the case of paper making pulp, there will be less good fiber removed with the rejects.

The introduction of the material to be screened into the area between the inner surface of the casing 12 and the outer surface of the partition 40 results in part of the lower consistency material being mixed with other material that has already been partly screened and therefore has a higher consistency. This will compensate for the dewatering effect commonly encountered in prior art apparatus of this general type.

From the above it will be apparent that the present invention provides an improved screen assembly which obviates the disadvantages of screens of this general type but without the necessity of complex manufacturing and maintenance procedures.

While the form of apparatus herein described constitutes a preferred embodiment of the invention, it is to be understood that the invention is not limited to this precise form of apparatus, and that changes may be made therein without departing from the scope of the invention.

What is claimed is:

1. In a screening assembly including an outer casing, a cover extending across said casing, a cylindrical screen disposed within said casing with an outer surface of said screen spaced from an inner surface of said housing, a floor extending between said casing and said screen and defining therewith an annular chamber, an inlet for feeding a suspension of solids and liquid into said annular chamber, an accepts outlet communicating with the interior of said cylindrical screen for withdrawing accepts which pass through said screen, and a rejects outlet for removing rejects which do not pass through said screen, the improvement comprising:

a partition mounted in said chamber intermediate said inner and outer surfaces of said casing and said screen, respectively, said partition extending upwardly from said floor partially about less than the full circumference of said screen from a position opposite said inlet to prevent direct flow from said inlet to said screen, and a baffle interposed between said inlet and rejects outlet for preventing direct flow from said inlet to said rejects outlet.

2. The assembly of claim 1 wherein:

axes of said casing and said screen are offset with respect to each other to define an enlargement in said annular chamber.

3. The assembly of claim 2 wherein:

said partition extends substantially parallel to said axes.

4. The assembly of claim 3 wherein:

said baffle extends between said partition and an opposite surface of said screen and slopes helically about said screen from adjacent said inlet to a point above said rejects outlet and defines with said screen, partition and floor a passage decreasing in area from adjacent said inlet to said rejects outlet.

5. The assembly of claim 4 wherein:

said inlet and said rejects outlet are substantially diametrically opposed with respect to each other.

6. The assembly of claim 5 wherein:

said partition decreases in height from adjacent said inlet to adjacent said rejects outlet.

7. The assembly of claim 1 wherein:

said inlet and said rejects outlet are substantially diametrically opposed with respect to each other.

8. The assembly of claim 1 wherein:

said partition decreases in height from a maximum height adjacent said inlet to a minimum height adjacent said rejects outlet.

9. The assembly of claim 1 wherein:

said means interposed between said inlet and rejects outlet extends substantially co-extensively with said partition about said screen.

10. The assembly of claim 1 wherein:

said baffle extends between said partition and an opposite surface of said screen and slopes helically about said screen from said inlet to a point above said rejects outlet and defines with said screen, partition and floor a passage decreasing in area from said inlet to said rejects outlet.

11. The assembly of claim 10 further comprising:

means for introducing a dilution liquid through said floor into said passage.

12. The assembly of claim 10 further comprising:

means for introducing purging liquid into said passage immediately upstream of said rejects outlet to assist in the removal of rejects therethrough.

13. In a screening assembly including a cylindrical outer casing, a cover extending across said casing, a cylindrical screen disposed within said casing with an outer surface of said screen spaced from an inner surface of said casing, a floor extending between said casing and screen and defining with said casing, cover and screen an annular chamber, an inlet through said casing for feeding a suspension of solids and liquid into said annular chamber, an accepts outlet for withdrawing accepts which pass through said screen, and a rejects outlet for removing material which does not pass through said screen, the improvement comprising:

said inlet and rejects outlet are substantially diametrically opposed with respect to each other about said casing, axes of said casing and said screen are offset with respect to each other to provide an enlargement in said annular chamber between said inlet and rejects outlet, a partition is mounted in said enlargement extending in parallel relationship to said axes of said casing and said screen intermediate said inner and outer surfaces thereof, one end of said partition is disposed opposite said inlet to prevent direct flow from said inlet to said screen, said partition decreases in height from a maximum at one end thereof, a helical baffle extends co-extensively with said partition between said partition and an opposite surface of said screen from adjacent said inlet to a point above said rejects outlet and defines with said screen, partition and floor a passage decreasing in area from said inlet to said rejects outlet, means is provided for introducing dilution liquid through said floor into said passage intermediate said inlet and rejects outlet, and means is provided for introducing purging liquid through said casing into said passage immediately upstream of said rejects outlet to assist in the removal of rejects therethrough.

* * * * *